United States Patent [19]

Kato

[11] Patent Number: 4,575,068

[45] Date of Patent: Mar. 11, 1986

[54] PAPER FEEDER

[75] Inventor: Kenji Kato, Tokyo, Japan

[73] Assignee: NEC Corporation, Tokyo, Japan

[21] Appl. No.: 570,524

[22] Filed: Jan. 13, 1984

[30] Foreign Application Priority Data

Jan. 18, 1983 [JP] Japan ..... 58-5238

[51] Int. Cl.[4] ..... B65H 3/52

[52] U.S. Cl. ..... 271/122

[58] Field of Search ..... 271/121, 122, 124, 167

[56] References Cited

U.S. PATENT DOCUMENTS 4,085,929 4/1978 Tuchiya ..... 271/122
4,192,497 3/1980 Perun ..... 271/121 X
4,376,530 3/1983 Akai ..... 271/121 X
4,416,449 11/1983 McInerny ..... 271/122

FOREIGN PATENT DOCUMENTS 135040 10/1980 Japan ..... 271/124

*Primary Examiner*—Richard A. Schacher
*Attorney, Agent, or Firm*—Laff, Whitesel, Conte & Saret

[57] ABSTRACT

An improved paper feeder, of the type including separator and presser belts, has an arm plate of elastomeric material, the arm plate being arranged in pressure contact with the feed roller. The arm plate is an aid to restrain the gravity caused pressure on said stacked sheets, for enabling the feeder to deal with a much heavier stack of sheets of paper than the weight of stacks which previous forms of feeders could accommodate.

12 Claims, 4 Drawing Figures

PAPER FEEDER

BACKGROUND OF THE INVENTION

This invention relates to paper feeders for successively feeding stacked sheets of paper, one by one, and is usable with a facsimile, a copying machine or the like.

Generally, in a facsimile apparatus, a plurality of sheets of paper are supplied in a stacked form and are fed in succession, one by one, for transmission. A paper feeder is disclosed in U.S. Pat. No. 4,085,929 which is usable with such device, and which comprises an inclined feed table on which a stack of paper sheets are placed. The stack of sheets is slidable along the feed table, under gravity, and into engagement with a feed roller which feeds the sheets forwardly in substantially the same direction that they move when they are brought into engagement with the feed roller.

An endless separator belt is arranged close to the feed roller and is in rotatable, pressure contact therewith, to run in a direction which is opposite to that in which the adjacent side of the feed roller proceeds. The belt pushes back all of the paper sheets other than the bottom one, thus allowing only the bottom sheet to be fed forward. Further, presser belt means are provided to press down the leading edges of the sheets other than the bottom one to prevent these sheets from being turned up at their leading edges or being raised partly in the vicinity of the feed roller under the effect of the separator belt running over the feed roller in the direction opposite to the direction of feed. There is no possibility that some sheets other than the bottom one cannot be smoothly fed forward even when engaged by the feed roller.

It has been found, however, that such previous form of paper feeder involves a disadvantage. If the number of paper sheets in a stack is increased freely, the correspondingly increased gravity component urges the sheets along the inclined feed table to the sheet-feeding region and may cause the separator and presser belts to yield under the pressure of the stacked sheets. This, combined with increase in friction between adjacent sheets, makes it difficult to feed the sheets separately one after another. In other words, if the number of stacked paper sheets exceeds a definite limit, the separator and presser belts become unable to function as intended and a plurality of sheets may be fed at a time. The previous paper feeder is thus subject to the disadvantage that the number of paper sheets in each stack laid on the feed table must be limited to a definite level for satisfactory operation.

SUMMARY OF THE INVENTION

The present invention has for its object the provision of an improved paper feeder of the type described which overcomes the above disadvantage previously encountered.

According to the present invention, a paper feeder comprises a feed table arranged at an angle of inclination, to slidably support thereon a stack of sheets of paper. A feed roller is arranged to engage the bottom sheet of the stack and to feed that sheet forwardly from the feed table. An endless separator belt is in pressure contact with and runs over the feed roller in a direction which is opposite to the direction in which the sheets of paper are fed. A presser belt means is arranged in pressure contact with the feed roller and with a portion extending at an angle to the sheets of paper which are being delivered from the feed table to the sheet-engaging peripheral region of the feed roller. The nip angle between the presser belt and feed table is smaller than the nip angle formed between the separator belt and such sheets of paper. The paper feeder is characterized in that it further comprises arm plate means of elastomeric material fixed at one end and having a portion adjacent to the other end which is held in pressure contact with the feed roller. The plate portion extends at an angle to the sheets of paper being delivered from the feed table to the sheet-engaging peripheral region of the feed roller, which angle is larger than the angle formed between the separator belt and such sheets.

The paper feeder of the present invention thus includes, separator and presser belt means which are similar to those employed in the prior art paper feeder. In addition, it includes an arm plate means of elastomeric material which is designed effectively to sustain the pressure of the stacked paper sheets, as urged forwardly under gravitation in cooperation with the separator and presser belt means. Also, the arm prevents the sheets from being raised or turned up along their leading edges, thus enabling successive delivery of individual stacked sheets from the feed table into the regions of pressure contact between the feed roller and the separator and presser belts, with increased reliability. Thus, according to the present invention, the advantage is gained because a stack of sheets can be set on the feed table which includes a greatly increased number of paper sheets, as compared with the previous form of paper feeder.

A few preferred embodiments of the present invention will next be described by way of example with reference to the accompanying drawings.

DETAILED DESCRIPTION OF THE PREFERRED EMBODIMENTS.

Figure 1:
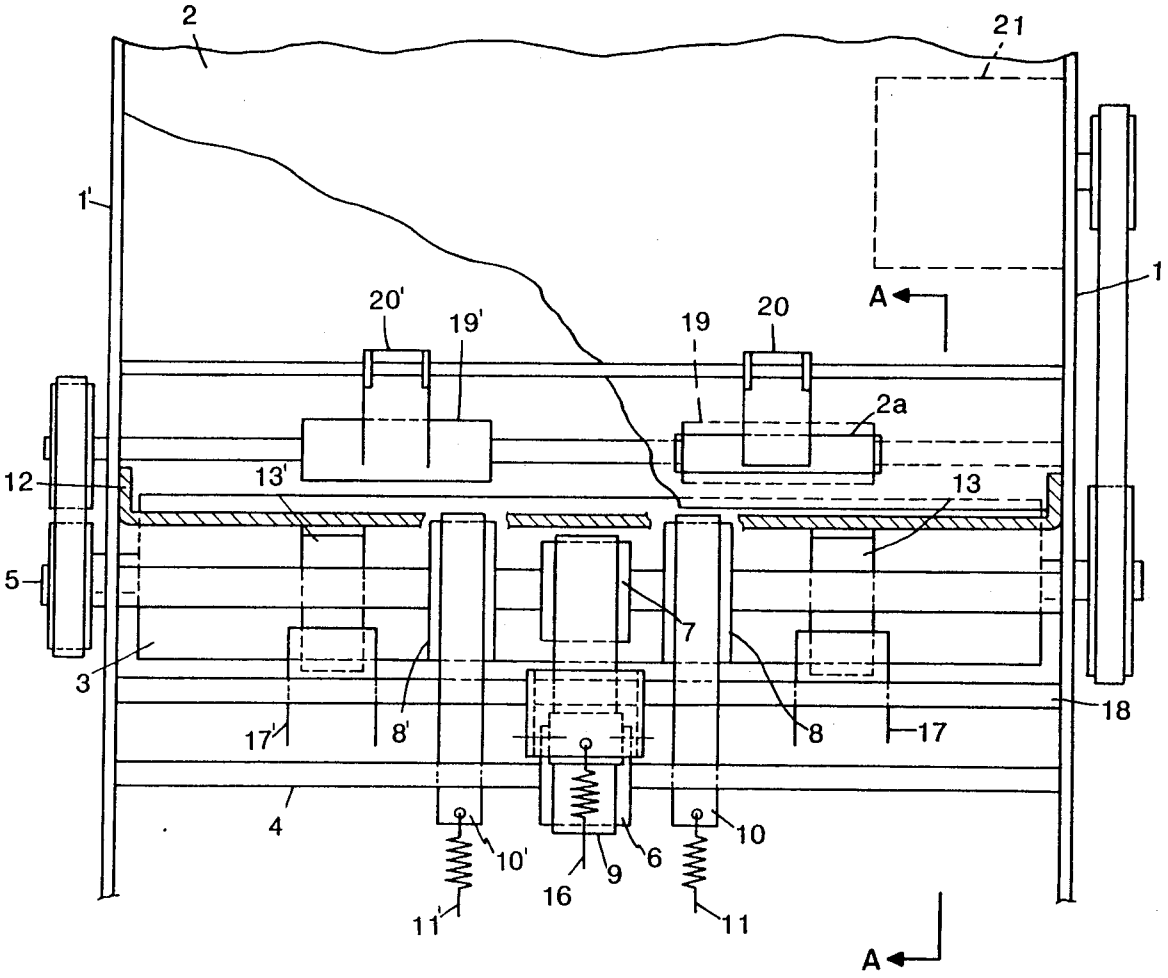
FIG. 1 is a plan view, partly in section, of a paper feeder embodying the present invention.
Figure 2:
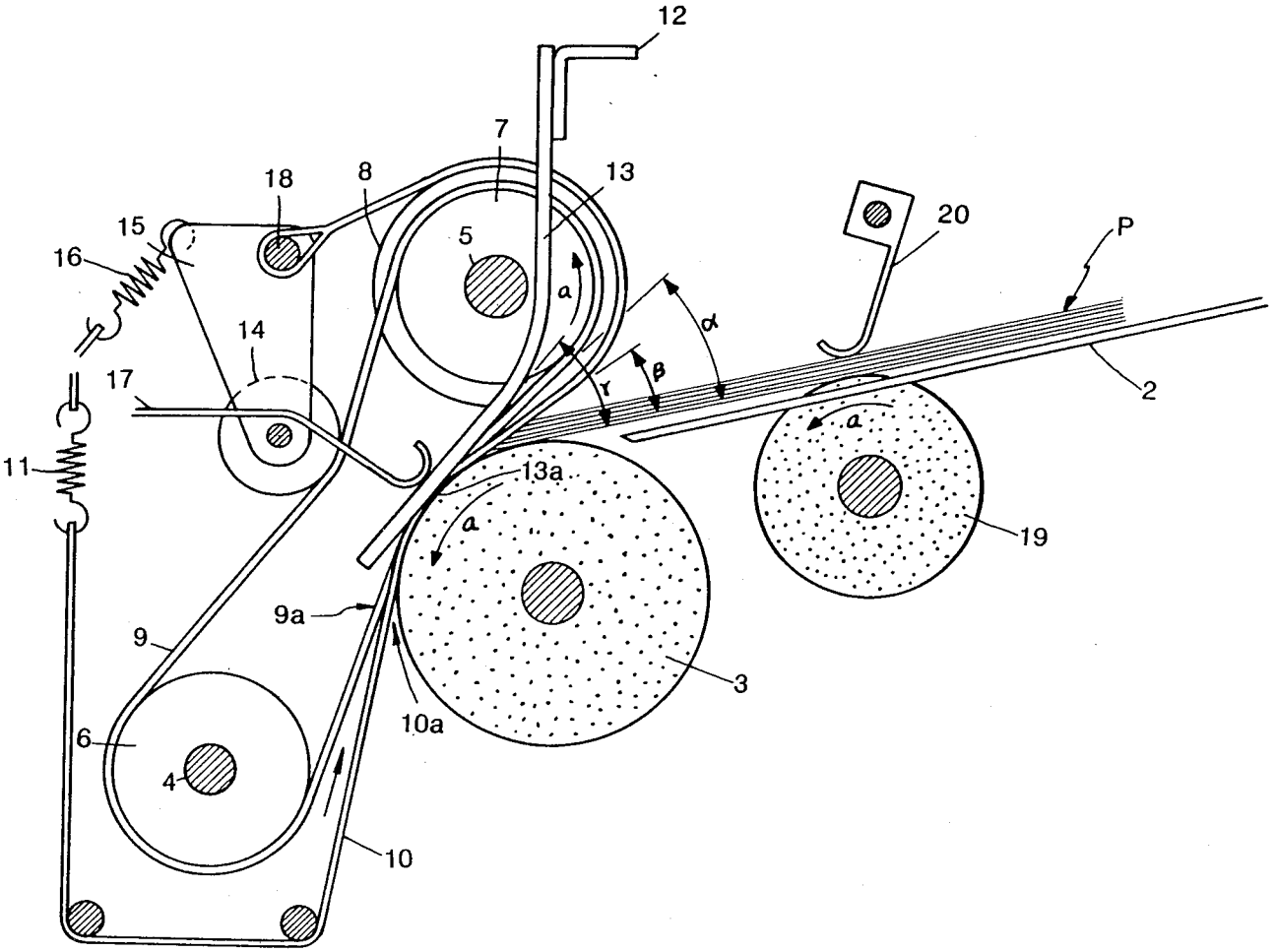
FIG. 2 is an enlarged cross section taken along the line A—A in FIG. 1.

With reference to FIGS. 1 and 2, numerals 1 and 1' indicate side plates of the body frame of the paper feeder, on which plates various members are mounted as described below. A feed table 2 is fixedly arranged between the side plates 1, 1' at an angle of inclination as shown in FIG. 2. Numeral 3 indicates a pickup or feed roller of an elastomeric material having a large coefficient of friction $\mu_1$ with respect to sheets of paper P. Feed roller 3 is located with its top peripheral region intersecting the plane of the feed table 2, as seen in FIG. 2.

A horizontal shaft 4 is mounted in front of the pickup or feed roller 3 (as seen in FIG. 2, leftwardly and downwardly with respect to feed roller 3). Another horizontal shaft 5 is positioned behind the pickup or feed roller 3 (as seen in FIG. 2, above pickup or feed roller 3). Small-sized pulleys 6 and 7 are mounted on the respective shafts 4 and 5. Pulley 7 is fixed to the shaft 5 while pulley 6 is rotatable relative to the shaft 4. Large-sized roller 8 and 8' (FIG. 1) are mounted on the shaft 5 and on the opposite sides of the pulley 7, which is fixed to the shaft. Pulleys 8, 8' serve as guide rollers for the respective presser belts 10 and 10'. Entrained about the pulleys 6 and 7 is an endless separator belt 9, formed of a material having a coefficient of friction $\mu_2$ with respect to the paper sheets P which is smaller than the coefficient of friction $\mu_1$ between the sheets P and pickup or feed roller 3 ($\mu_1 > \mu_2$). Presser belts 10, 10' are wrapped around the respective large-sized pulleys 8, 8' and are fixed at one end to a horizontal rod 18 (FIG. 2). Belts 10, 10' are held in pressure contact with the pickup or feed roller 3 under the action of their respective tension springs 11, 11' which are secured to the other ends of the presser belts.

In FIG. 2, the nip angle $\alpha$ is formed between the separator belt 9 and paper sheets P coming into engagement with the pickup or feed roller 3. Nip angle $\gamma$ is larger than nip angle $\beta$ formed between the presser belts 10, 10' and paper sheets P. That is, the separator and presser belts are arranged in the angular relationship of $\alpha > \beta$ with respect to the sheets P.

Arm plates 13 and 13', of elastomeric material, are fixed at one end to a support stay 12, and are arranged on the right and left sides of separator belt 9, as viewed in FIG. 1. These arm plates are held in pressure contact with the pickup or feed roller 3, the contacting portions of respective arm plates extending at a nip angle $\gamma$ with respect to the paper sheets P coming into engagement with the feed roller 3, the angle $\gamma$ being selected to meet the nip angle conditions of $\gamma > \alpha > \beta$, as shown in FIG. 2.

Tension means, including a roller 14, a link 15 rotatably mounted on the rod 18, and a coiled spring 16, are provided to hold the separator belt 9 in pressure contact with the feed roller 3. Leaf spring members 17 and 17' hold the respective elastomeric arm plates 13, 13' in pressure contact with the pickup or feed roller 3. Coiled springs 11, 11' tension and hold the respective presser belts 10, 10' in pressure contact with the pickup or feed roller 3.

Auxiliary rollers 19 and 19' are disposed beneath the forward end portion of feed table 2 with their top peripheral portions protruding upwardly through respective apertures 2a and 2a' (2a' is not shown in FIG. 1) formed in the table portion. Swing lever arms 20 and 20' are arranged above the respective auxiliary rollers 19, 19' to hold the paper sheets P against them so that the sheets P are positively moved forward along the feed table 2.

With the arrangement described above, when an electric motor 21 is started, the pickup or feed roller 3 is driven by belt drive means to rotate in a direction indicated at a in FIG. 2 and, by appropriate belt transmission means (not shown), small-sized pulley 7 and auxiliary rollers 19, 19' are driven to rotate in the same direction a. Separator belt 9 is thus driven to run along and maintain contact with the feed roller 3, at 9a. Separator belt 9 runs in a direction which is opposite to the direction in which the adjoining peripheral portion of the feed roller 3 proceeds. Stacked sheets of paper P are laid on the feed table 2 and are moved forward by rotation of auxiliary rollers 19, 19', to enter the nip between the feed roller 3 and the separator 9 and presser 10, 10' belts.

On this occasion, only the bottom one of the stacked paper sheets is subjected to a large frictional force of the pickup or feed roller 3 so as to be fed forwardly. The feeding action on the bottom sheet is aided by the presser belts 10, 10' and elastomeric arm plates 13, 13'.

On the other hand, all of the paper sheets P, other than the bottom one, coming into contact with the separator belt 9 are held at their leading edges, against any further movement in the feed direction. They are more or less pushed back by the separator belt 9, which runs in the direction opposite to the sheet delivery direction. In this connection, it is to be noted that, although the sheets P, other than the bottom one, also come into contact with the presser belts 10, 10' in a position which is spaced from the separator belt 9, there is no forward delivery of such sheets under the effect of presser belts 10, 10' since the coefficient of friction $\mu_3$ between the presser belts 10, 10' and the paper sheets P is smaller than the coefficient $\mu_2$ between the separator belt 9 and the sheets P ($\mu_2 > \mu_3$). The presser belts 10, 10' hold down the leading edges of the stacked sheets, other than the bottom one, to prevent the sheets from floating or being turned up at their leading edges.

When the stack of paper sheets P has a large weight, as when it includes a great number of sheets (e.g., 50 to 100 sheets), the separator belt 9 and presser belts 10, 10' may yield under the pressure of stacked sheets P to reduce the area of their regions 9a and 10a of contact with the pickup or feed roller 3, allowing the leading edges of the sheets to proceed to the regions of contact 13a of elastomeric arm plates 13, 13'. In this case, the arm plates 13, 13' sustain the pressure or weight component of the stack of paper and prevent the sheets P, other than the bottom one, from being fed forwardly, thus aiding the function of separator belt 9. As will be apparent, the coefficient of friction $\mu_4$ between adjacent paper sheets is smaller than coefficient $\mu_1$ between the pickup or feed roller 3 and paper sheets ($\mu_1 > \mu_4$); therefore, the paper sheets are successively fed forward one after another, each sheet gradually descending in the sheet stack.

In this manner, the number of paper sheets P remaining on the feed table 2 gradually decreases. When the weight of the stack is reduced to enable the separator belt 9 to function normally as designed, the elastomeric arm plates 13, 13' start to prevent the sheets, other than the bottom one, from floating or being turned up at their leading edges, in the same fashion as the presser belts 10, 10'. It will be appreciated, therefore, that at all times only the bottom sheet in the stack is fed forward irrespective of the number of paper sheets in the stack. This enables a stable feeder operation, enabling all of the stacked sheets to be fed forward, successively one after another.

Figure 3:
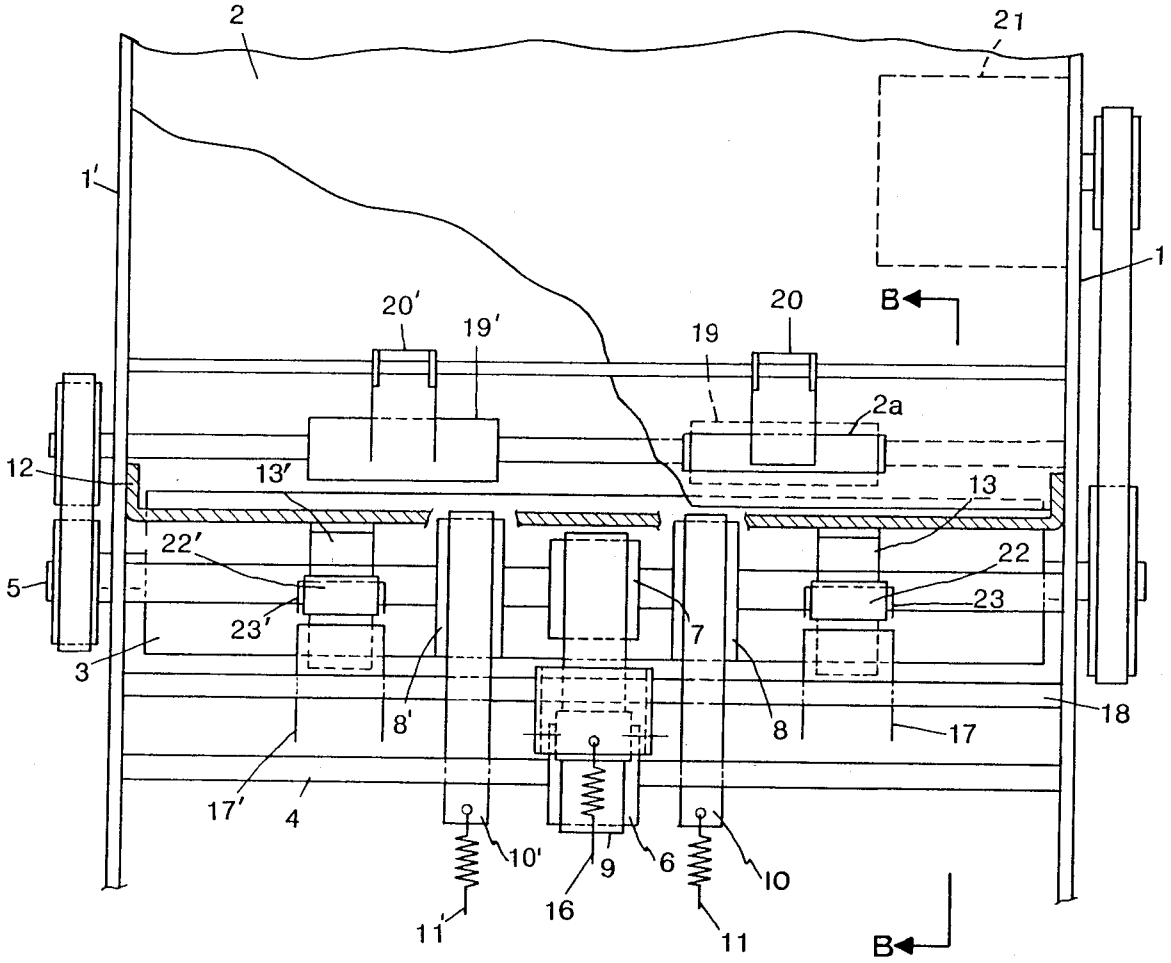
FIG. 3 is a view similar to FIG. 1, illustrating an alternative embodiment of the invention.
Figure 4:
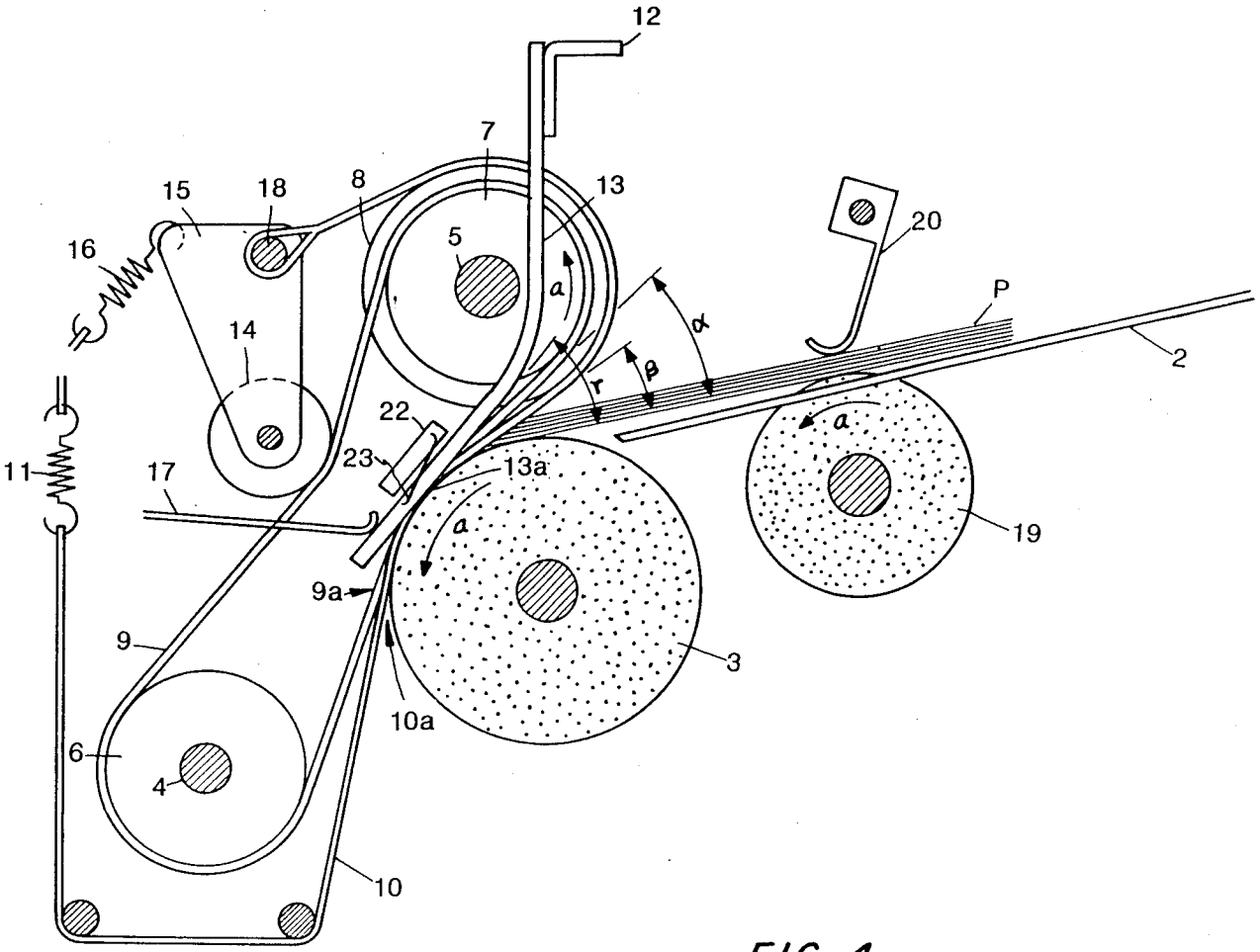
FIG. 4 is an enlarged cross section taken along the line B—B in FIG. 3.

Reference will next be had to FIGS. 3 and 4 which illustrate a second preferred embodiment of the present invention. This embodiment is basically similar in structure to the first embodiment shown in FIGS. 1 and 2, but is different therefrom in that back-up members 22 (22') and guide springs 23 (23') are added and that spring members 17, 17' are slightly displaced toward the free ends of the elastomeric arm plates 13, 13'. In FIGS. 3 and 4, the same reference numerals have been applied to various corresponding parts and no description of such parts will be repeated for this embodiment.

Back-up members 22 (22') are arranged behind the respective elastomeric arm plates 13, 13' and, in the normal condition of feeder operation, are spaced a predetermined distance therefrom, as shown. Each of the guide springs 23 (23') is arranged to extend from the opposite sides of the associated back-up member 22 (22') to straddle the adjacent one of the elastomeric arm plates 13, 13' in order to hold down the sheet of paper being fed forward.

If the number of paper sheets in a stack set on the feed table exceeds the number that can be satisfactorily handled with the first embodiment, the elastomeric arm plates 13, 13' are unable to sustain the weight of stacked sheets. First, the guide springs 23 (23') start to support the weight of the sheet stack in cooperation with the arm plates 13, 13', which are raised under the stack weight. If the stack weight is further increased, the arm plates 13, 13' come into contact with the back-up members 22 (22') to be held thereon. Thus, any further increase in the angle of contact between the feed roller and the arm plates is effectively prevented.

It will be appreciated from the foregoing that, according to the present invention, a paper feeder is realized which is capable of dealing with much larger sheet stacks than previous forms of paper feeders of the type having separator and presser belt means. The invention does this by an incorporation, in the previous feeder structure, of the arm plates of elastomeric material and, if required, also the back-up members and guide springs.

Those who are skilled in the art will readily perceive how to modify the invention. Therefore, the appended claims are to be construed to cover all equivalent structures which fall within the true scope and spirit of the invention.

What is claimed is:

1. A paper feeder for picking sheets off the bottom of a stack of paper, said feeder comprising an inclined plane for receiving a stack of paper sheets and gravity feeding said stack toward a pick up station, rotating feed roller means at said pick up station for frictionally engaging the lowermost sheet in said stack and propelling it away from said stack in the direction of said gravity feed, separator means comprising a running belt moving in a direction which pushes back all except the lowermost of said sheets in said stack to oppose said gravity feed, a nip angle being formed between said feed roller and said separator means, pressure means for aiding said separator means by resisting the weight of said stack of paper acting on said separator means whereby said separator has to accommodate the weight of only a few sheets paper, and means comprising elastomeric material in pressure contact with said feed roller means for assisting said pressure means, elastomeric material forming an angle with said sheets of paper which is greater than said nip angle.

2. The paper feeder of claim 1 wherein said rotating feed roller turns about an axis of rotation; and said running belt, said pressure means, and said elastomeric material make pressure contact with said feed roller along a line which is parallel to said axis of rotation.

3. The paper feeder of claim 1 wherein there is a coefficient of friction $\mu_1$, between said feed roller and said sheets of paper and a coefficient of friction $\mu_2$ between said separator means and said paper, the relationship of said coefficients being $\mu_1 > \mu_2$.

4. The paper feeder of claim 2 wherein there is a coefficient of friction $\mu_3$ between said pressure means and said sheets of paper, said coefficients having a relationship wherein $\mu_2 > \mu_2$.

5. The paper feeder of claim 4 wherein the coefficient of friction $\mu_4$ between sheets of paper has the relationship $\mu_1 > \mu_4$.

6. The paper feeder of claim 1 wherein an angle $\alpha$ is formed between said separator means and said paper, an angle $\gamma$ is formed between said pressure means and said paper, and said nip angle is $\beta$, the relationshp being $\alpha > \beta$, said elastomeric material being an elongated arm anchored at one end to a stationary support element on said paper feeder, said arm being free on the other end to ride on the side of said paper which is opposite to the side engaged by said feed roller, the angle of said arm relative to said paper being greater than $\beta$.

7. The paper feeder of claim 1 wherein said elastomeric material is an elongated arm anchored at one end and free on the other end to ride on the side of the said paper which is opposite to the side engaged by said feed roller, and means urging said other end of said arm against said other side of said paper and in pressure contact with said feed roller.

8. The paper feeder of claim 7 and stationary back-up means removed from said other end of said arm and near said feed roller, the distance separating said back-up means and said feed roller being substantially equal to the thickness of a maximum allowable number of said sheets passing simultaneously through said paper feeder.

9. The paper feeder of claim 8 and supplementary spring means for urging said elongated elastomeric arm away from said back-up means and toward said feed roller.

10. The paper feeder of claim 9 wherein there is a coefficient of friction $\mu_1$, between said feed roller and said sheets of paper and a coefficient of friction $\mu_2$ between said separator means and said paper, there is a coefficient of friction $\mu_3$ between said pressure means and said sheets of paper, and there is a coefficient of friction $\mu_4$ between sheets of paper has the relationship of the coefficients being $\mu_1 > \mu_2 > \mu_3$ and $\mu_1 > \mu_4$.

11. A paper feeder comprising a feed table arranged at a predetermined angle of inclination to slidably support thereon a stack of sheets of paper, a feed roller engaging the bottom sheet of the stack to feed the sheets forwardly from the feed table, means including an endless separator belt in pressure contact with the feed roller and running thereover in a direction which is opposite to the direction in which the sheets of paper are fed, presser belt means in pressure contact with the feed roller and having a portion extending in a nip angle with respect to the sheets of paper being delivered from the feed table to the sheet-engaging peripheral region of the feed roller, said nip angle being smaller than a nip angle formed between the separator belt and said sheets of paper, and arm plate means of elastomeric material, said plate means being fixed at one end and having a portion adjacent to the other end which is held in pressure contact with the feed rollers, said adjacent portion of the arm plate means extending at an angle with respect to the sheets of paper being delivered from the table and with respect to the sheet-engaging peripheral region of the feed roller which angle is larger than the nip angle formed between the separator belt and said sheets of paper.

12. The paper feeder of claim 11 wherein said feed roller turns about an axis of rotation; and said endless separator belt, said pressure belt, and said arm plate make contact with said feed roller along a line which is parallel to said axis of rotation for said feed roller.

* * * * *